United States Patent [19]

Campeau

[11] 4,073,500

[45] Feb. 14, 1978

[54] WHEEL BOARD UNDULATING COASTER

[76] Inventor: Leo Campeau, 6621 Arcola Street, South Burnaby, British Columbia, Canada, V5E 1H2

[21] Appl. No.: 717,041

[22] Filed: Aug. 24, 1976

[51] Int. Cl.[2] ..... B60D 3/00

[52] U.S. Cl. ..... 280/87.04 R; 280/47.1

[58] Field of Search ..... 280/87.04 R, 87.04 A, 280/11.1 BT, 11.19, 47.1

[56] References Cited

U.S. PATENT DOCUMENTS

| | | | |
|---|---|---|---|
| D. 214,252 | 5/1969 | Andersen | 280/87.04 A |
| D. 214,575 | 7/1969 | Fravel | 280/87.04 A |
| 2,198,667 | 4/1940 | Hagenes | 280/87.04 A |
| 3,152,813 | 10/1964 | Brown | 280/87.04 A |

*Primary Examiner*—Joseph F. Peters, Jr.
*Assistant Examiner*—John A. Pekar
*Attorney, Agent, or Firm*—Robert D. Farkas

[57] ABSTRACT

This disclosure pertains to a rigid board-like surface having three casters affixed to the undermost surface thereof. Two of the casters are disposed in spaced apart relationship and co-axially aligned at one end of the board. The remaining caster is located at the other end of the board. Each caster utilizes an eccentric wheel, causing the board to undulate when rolling down an inclined surface. An inverted U-shaped rail is affixed to the uppermost surface of the board to which is attached a rope-like cord utilized to provide a grasp for the user of the apparatus.

3 Claims, 6 Drawing Figures

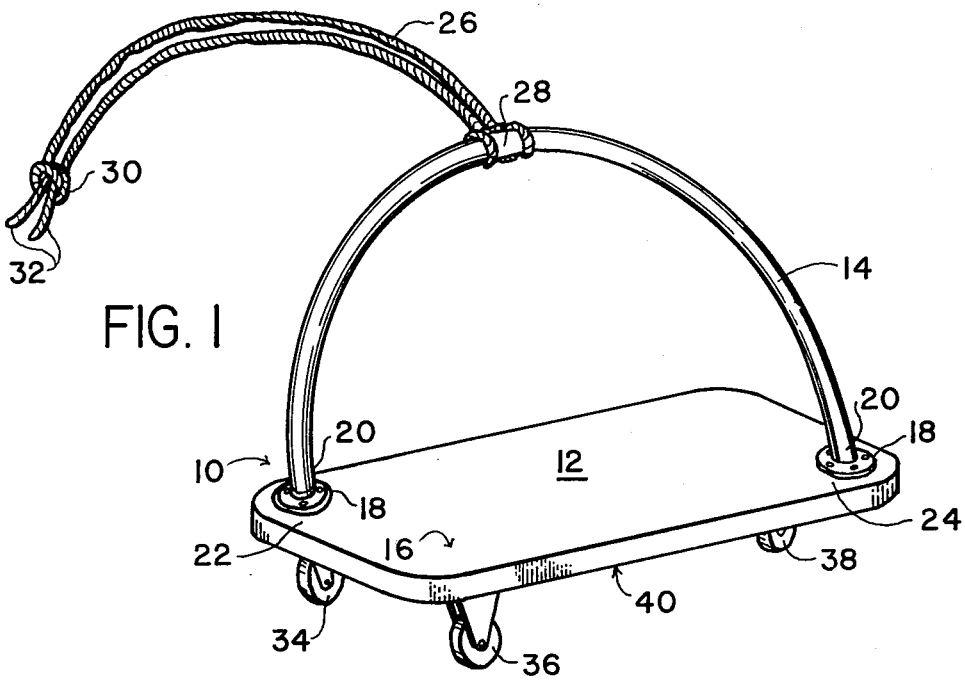
FIG. 1
FIG. 2
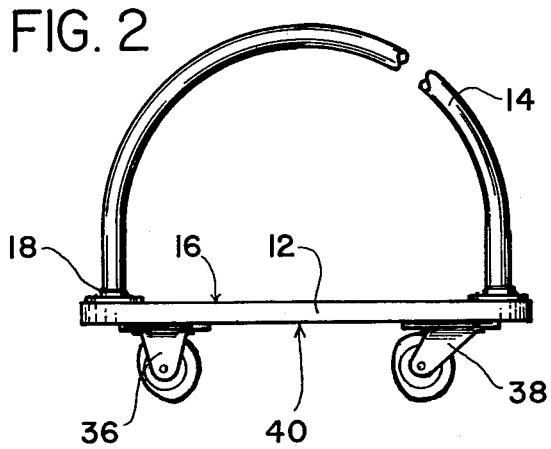
FIG. 3
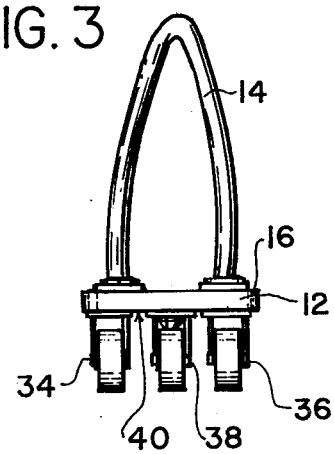
FIG. 4
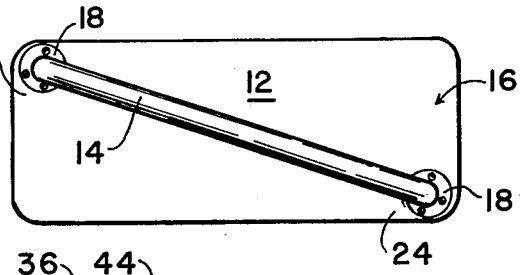
FIG. 5
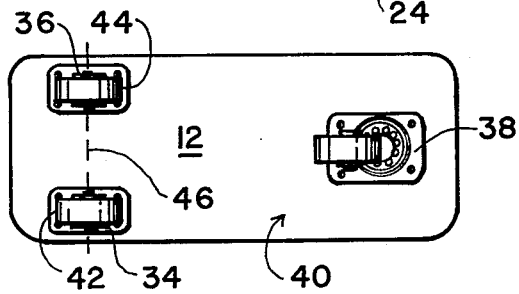
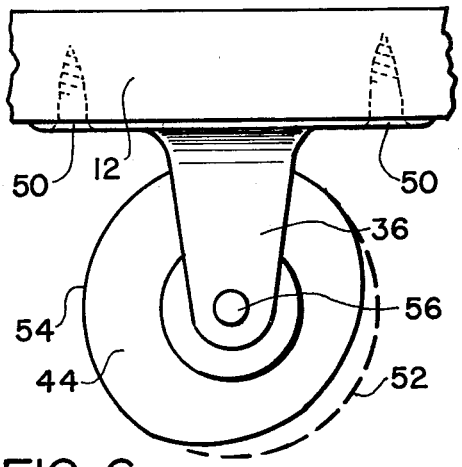
FIG. 6

WHEEL BOARD UNDULATING COASTER

BACKGROUND OF THE INVENTION

This invention relates to rolling boards supported by wheels, utilized as an amusement device, and more particularly to that class which provides a bucking undulating motion when in use.

DESCRIPTION OF THE PRIOR ART

The prior art abounds with apparatus which requires balancing skills by the user.

U.S. Pat. No. 3,833,214 issued on Sept. 3, 1974 to F. J. Isdith and U.S. Pat. No. 3,684,305 issued on Aug. 15, 1972 to B. J. McDonald et al. both teach platforms which require balancing skill on the part of the user. The Isdith Patent utilizes a pair of wheels to which is affixed a U-shaped bar forming vertical handle members which are grasped by the user and act as an aid in balancing. The McDonald Patent discloses separate foot platforms, each provided with control handles attached thereto which simulate ski poles. A swinging movement applied to the ski poles facilitate banking control by a rider standing on the platforms which affects the steering of the apparatus.

SUMMARY OF THE INVENTION

A primary object of the present invention is to provide an amusement device which simulates the bucking action of a wild horse.

Another object of the present invention is to provide a ridable platform which can be steered by pitching the platform through the application of forces applied by the knees of the user.

Still another object of the present invention is to provide a rolling board which undulates along the forward direction of travel and from side to side at a rate proportioned to the speed of travel of the board.

Yet another object of the present invention is to provide an amusement apparatus which employs skills utilized in skiing, surfing, and wild horse riding.

The present invention expands the balance required in riding two wheeled boards by providing a surface which undulates from side to side as well as in an up and down direction as it is propelled on a smooth supporting surface. A rope, affixed to an upside down U-shaped supporting rail member simulates a cinch rope of a horse whilst the support member allows the user to more intimately control the direction taken by the board and gain lateral support therefrom.

These objects as well as other objects of the present invention, will become more readily apparent after reading the following description of the accompanying drawings.

BRIEF DESCRIPTION OF THE DRAWINGS

FIG. 1 is a perspective view of the present invention.

FIG. 2 is a side elevation view of the present invention.

FIG. 3 is a rear elevation view of the present invention.

FIG. 4 is a top plan view of the present invention.

FIG. 5 is a bottom plan view of the present invention.

FIG. 6 is a side elevation view of a stationary caster utilized in the present invention.

DESCRIPTION OF THE PREFERRED EMBODIMENT

The structure and method of fabrication of the present invention is applicable to a wheel board undulating coaster. A rigid board-like surface is provided, preferably fabricated from 12 inch wide plywood. A 4 foot length of half-inch galvanized pipe is formed into a U-shape, having each of the free ends thereof threadingly engage a pipe flange. The pipe flanges are bolted to the uppermost surface of the board so as to have the U-shaped pipe member disposed in inverted U-shaped fashion secured to the board. A length of rope or leather thonging is secured at the central portion thereof to the pipe, having the free ends knotted together so as to provide a cinch-like hand grasping member to be grasped by the user. Three casters are secured to the undermost surface of the board, each being disposed so as to form an isosceles triangle. Two of the casters are of the non-swivel variety and have the wheels thereof rotate about a common line disposed parallel to a shorter edge of the board. The other caster is of the swivel variety and is disposed adjacent the other short end of the board. All the casters utilize eccentric wheels fabricated by either grinding away portions of the peripheral surface of each wheel or by simply journalling each wheel eccentrically to the shaft about which it rotates.

The preferred embodiment utilizes the upside down U-shaped support member secured at each free end thereof to diametrically opposed corners of the board. An alternate embodiment aligns the free ends of the U-shaped member along the midline parallel to the longest marginal edges of the board.

Now referring to the figures and more particularly to the embodiment illustrated in FIG. 1 showing the present invention 10 employing a rectangular board 12. U-shaped supporting member 14 is shown fixedly secured to the uppermost surface 16. Pipe flanges 18 fixedly secure ends 20 of U-shaped member 14 to surface 16 and are shown disposed in diametrically opposed corners 22 and 24 of board 12. Cinch-like rope element 26 frictionally grasps supporting element 14 at mid-portions 28 thereof. Knot 30 joins together portions of rope element 26 adjacent the free ends 32 thereof. Casters 34, 36, and 38 are affixed to lowermost surface 40 of board 12.

FIG. 2 illustrates board 12 to which is secured flanges 18 and U-shaped supporting element 14 on surface 16 thereof. Caster 36 is of the non-swivel variety whilst caster 38 is of the swivel variety.

FIG. 3 shows U-shaped member 14 secured to the uppermost surface 16 of board 12 and casters 34, 36, and 38 secured to the lowermost surface 40 of board 12. Caster 38 is disposed midway between casters 34 and 36.

FIG. 4 illustrates U-shaped member 14 fixedly secured at the free ends thereof to surface 16 of board 12 at diametrically opposed corners 22 and 24 utilizing flanges 18 thereof.

FIG. 5 shows the undersurface 40 of board 12, to which non-swivelable casters 34 and and 36 and swivel caster 38 are affixed. Casters 34 and 36 employ wheels 42 and 44 respectively, each co-axially aligned along dotted lines 46. Caster 38 is affixed to surface 40 midway between casters 34 and 36 and disposed away from dotted lines 46. Caster 38 employs wheel 48 which has an eccentric peripheral surface. Wheels 42 and 44 similarly employ peripheral surfaces eccentrically disposed to the axis about which they are free to rotate.

FIG. 6 illustrates caster 36 affixed to board 12 utilizing screws 50 therefor. Wheel 44 is made eccentric by grinding away a portion of the peripheral surface 52, shown by dotted lines, leaving an eccentrically non-circular peripheral surface 54 which creates the undulating action of the present invention. Axle 56 may be disposed in a wheel, not shown, having a truly circular peripheral surface, at a location other than the centroid of the peripheral surface, so as to create an eccentrically disposed peripheral surface. It should be understood that wheel 44, however fabricated, is typical of wheels 42 and 48 shown in FIG. 5.

One of the advantages of the present invention is an amusement device which simulates the bucking action of a wild horse.

Another advantage of the present invention is a ridable platform which can be steered by pitching the platform through the application of forces applied by the knees of the user.

Still another advantage of the present invention is a rolling board which undulates along the forward direction of travel and from side to side at a rate proportioned to the speed of travel of the board.

Yet another advantage of the present invention is to provide an amusement apparatus which employs skills utilized in skiing, surfing, and wild horse riding.

Thus, there is disclosed in the above description and in the drawings, an embodiment of the invention which fully and effectively accomplishes the objects thereof. However, it will become apparent to those skilled in the art, how to make variations and modifications to the instant invention. Therefore, this invention is to be limited, not by the specific disclosure herein, but only by the appending claims.

The embodiment of the invention in which an exclusive privilege or property is claimed are defined as follows:

1. A wheel board undulating coaster comprising a generally planar platform, three ground contacting wheels mounted for rotation on the underside of the platform and positioned in a triangular arrangement, means for mounting one of the three wheels for swiveling movement about a vertical axis normal to the axis of rotation thereof, and all three wheels having peripheral surfaces eccentric to the axes of rotation thereof, a generally U-shaped support member, said support member affixed on the uppermost side of the platform, the free ends of the U-shaped member being disposed fixedly secured to said uppermost side of said platform, said platform having a generally rectangular shape, said free ends being disposed adjacent diametrically opposed corners of said platform.

2. The device as claimed in claim 1 further comprising a line, a portion of said line being disposed tied to said member.

3. The device as claimed in claim 1 wherein the other two of said three wheels are disposed having a common axis of rotation, said common axis of rotation being disposed adjacent and parallel to one of the shorter marginal edges of said platform.

* * * * *